United States Patent [19]

Lemelson

[11] 4,006,540

[45] Feb. 8, 1977

[54] FILAMENT WINDING CRAFT

[76] Inventor: Jerome H. Lemelson, 85 Rector St., Metuchen, N.J. 08840

[22] Filed: Sept. 19, 1975

[21] Appl. No.: 615,129

[52] U.S. Cl. ..... 35/27; 428/13; 428/16; 428/542

[51] Int. Cl.[2] ..... B44F 7/00

[58] Field of Search ..... 35/26, 27, 28, 18 A; 40/152, 154, 128; 428/13, 16, 542; 273/156

[56] References Cited

UNITED STATES PATENTS

| | | | |
|---|---|---|---|
| 448,974 | 3/1891 | Lyon | 273/156 |
| 3,038,272 | 6/1962 | Colston | 428/542 |
| 3,501,880 | 3/1970 | Bosch | 428/542 X |
| 3,589,034 | 6/1971 | Beecham | 35/26 |
| 3,690,998 | 9/1972 | Brynjegard | 428/542 |
| 3,752,730 | 8/1973 | Koff | 35/27 X |
| 3,766,960 | 10/1973 | McLaughlin | 35/27 UX |
| 3,905,133 | 9/1975 | Charman | 35/27 |

*Primary Examiner*—Harland S. Skogquist

[57] ABSTRACT

A craft is provided which employs one or more rigid frames which are so constructed as to facilitate the winding of one or more filaments or wires therearound to form an envelope or envelopes of the filaments to permit the construction of geometric configurations representing abstract art, figures, animals and other forms. In one form, the frames are produced of molded plastic and contain scalloped edges which are shaped with indentations in which indentations a filament may be nested as it is wrapped around the frame so as to predeterminately dispose the filament in selected spaced-apart locations on the frame. In another form, the frames are molded with a plurality of equispaced protrusions around which filament material may be wrapped and retained thereby to form the envelope of filamentary wrappings. The frames are also constructed so that they may be easily assembled and retained together to form a three-dimensional skeletal support for the filamentary material.

7 Claims, 5 Drawing Figures

FILAMENT WINDING CRAFT

SUMMARY OF THE INVENTION

This invention relates to new and improved structures in components for a filamentary or wire wrapping craft wherein the components may be easily assembled together and substantially reduce the labor required to complete objects of art in performing such craft. In particular, the invention is concerned with improvements in the components of a craft employing one or more filaments of flexible or bendable material which is capable of being wrapped around a frame or an assembly of frames many times to define an abstract art object or one in which the multiple filament wrappings define a familiar surface.

The conventional filament wrapping craft involves and requires the hammering of a multitude of nails or pins against a board or into a frame wherein each of the pins serves as an anchor or retainer for one or more filament windings. This procedure is quite tedious and time consuming. The instant invention employs frame structures which may be easily fabricated at low cost and contain means for predeterminately retaining one or more filaments thereon which are easily wrapped around the frame, without the need for applying pins or nails to the frame.

Accordingly, it is a primary object of this invention to provide new and improved structures in craft components which may be utilized to produce filamentary configurations representing figures and abstract forms.

Another object is to provide improvements in art forms on which wires on which wires or filaments may be wound to provide sculpture-like formations, wherein the art forms are molded with a plurality of retaining means for one or more filaments or wires which may easily be wrapped back and forth or around the art forms to provide three dimensional and eye catching formations of said wires and filaments.

Another object is to provide improvements in the structures of art forms having a plurality of filament or wire retaining or guiding means and also having integrally molded formations permitting easy assembly of said forms to form three dimensional arrays thereof and means for retaining wrapped elements in three dimensional array.

Another object is to provide structures in wire wrapping art forms with wire retaining means molded integral therewith in simple two piece and without the need for complex cam action molds.

Another object is to provide new forms of three dimensional art.

With the above and such other objects in view as may hereinafter more fully appear, the invention consists of the novel constructions, combinations and arrangements of parts as will be more fully described and illustrated in the accompanying drawings, but it is to be understood that changes, variations and modifications may be resorted to which fall within the scope of the invention as claimed.

Figure 1:
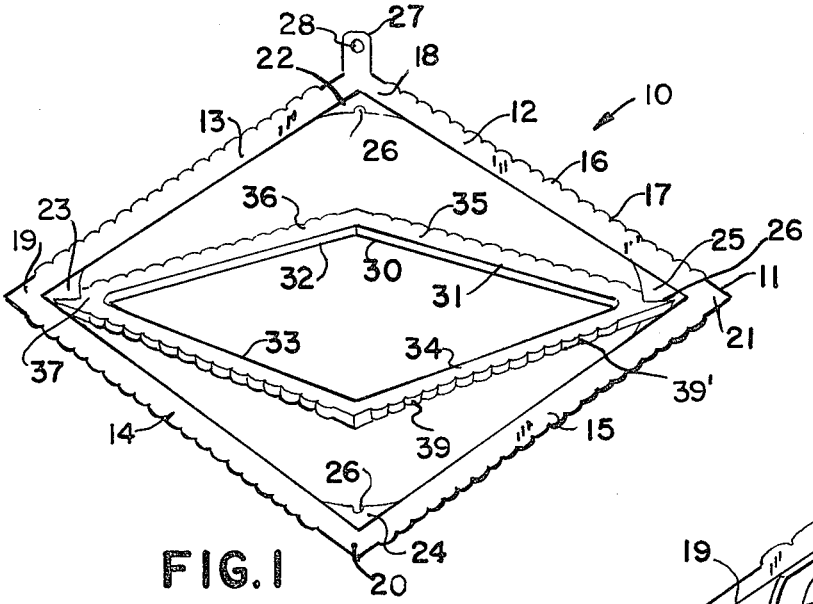
FIG. 1 is an isometric view of a filament winding craft preform assembly composed of two diamond shaped frames supported one inside the other, prior to a winding operation thereon.

In FIG. 1, an assembly 10 is provided which is formed of two frames denoted 11 and 30. The frame 11 is somewhat diamond shaped and comprises the outer frame of the assembly with the frame 30 secured within and extending laterally outwardly from frame 11.

Although frames 11 and 30 may be formed by die cutting sheet material such as paperboard, wood, plastic or metal, they are preferably formed by injection molding a thermoplastic polymer to the configurations illustrated or to any suitable pair of configurations which, when assembled one inside the other with the inside frame extending laterally outwardly from the other frame, define respective guides and retainers for a plurality of turns of a thread or filament T of plastic, natural textile material such as wool or cotton, or wire of soft metal such as copper.

Figure 3:
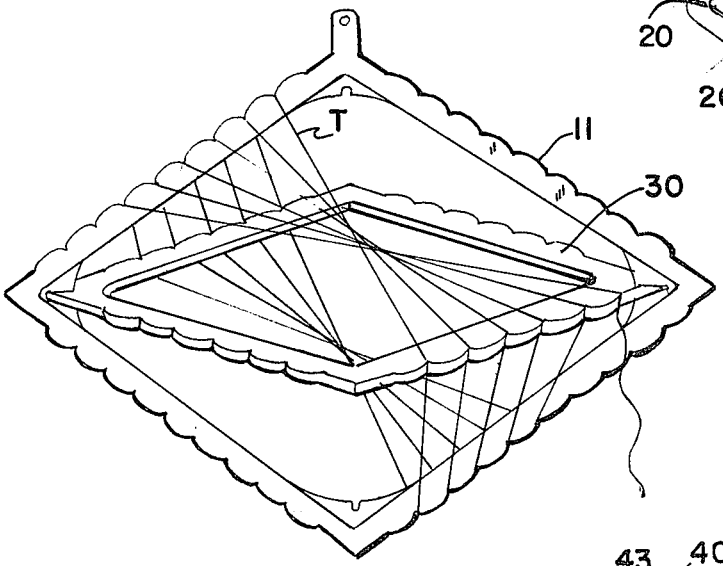
FIG. 3 is an isometric view of the assembly illustrated in FIG. 1 with a filament partially wound thereon.

Frame 11 is formed of four strip-like formations 12, 13, 14 and 15 having a somewhat diamond configuration. The outer edges of each strip-like portion are formed with a plurality of scallop-like protrusions 16 with each two adjacent protrusions defining an indentation 17 in the edge, into which indentation a wire or thread may extend as it is wrapped around the frame or a combination of the two frames as illustrated in FIG. 3. The envelope of wire or thread turns wrapped many times around the frame or frame assembly, defines an array of filamentary portions of the length of wire or thread which comprises an attractive art form which is pleasing to the eye.

The outer frame 11 is provided with fillet-like formations 22, 23, 24 and 25 at each of the apices or corners of the frame, denoted 18, 19, 20 and 21. Each of the fillet-like formations is provided with a notch or slotted-cavity 26 extending towards the apex of the sides of the frame for frictionally receiving and retaining an apex of an inner frame.

Figure 2:
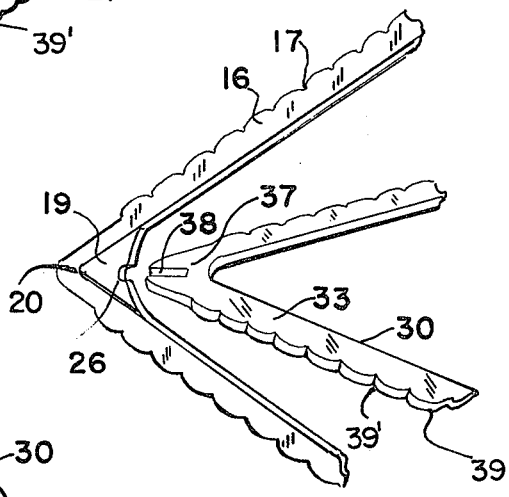
FIG. 2 is a partial view of a portion of the assembly of FIG. 1 with the components disassembled.

The frame 30 is shown having four strip-like frame portions denoted 31, 32, 33 and 34 which form a somewhat diamond-like frame shape with the apices defined by the strip-like frame portions 32 and 33 and the frame portions 31 and 34 adapted to frictionally assemble in the notch-like indentations in the fillet portions 23 and 25 of the frame. The apex portion 37 at one end of frame 30 is shown in FIG. 2 as containing an indentation or notch 38 of such a width as to permit frictional assembly of the side walls of the notch with the fillet formation 26 at the apex portion 20 of frame 11, as shown in FIGS. 1 and 3. A similar notch-like indentation is provided at the opposite apex of the frame 30.

Although not illustrated, a third frame may extend within frame 30 between the apex portions 19 and 21 of frame 11 and frictionally assembled with the fillet portion 22 and 24 and retained from lateral movement by engagement of the notch indentations 26 of the fillet formations with the inside surfaces of the notch indentations of the frame in a manner similar to that employed to secure frame 30 within frame 11 as illustrated in FIG. 1.

Frame 30 also contains the outer edging thereof shaped with a plurality of scallop-like formations 39 similar to the formations 16 of frame 11 and operable to provide indentations along the outer edge of the frame into which indentations a thread or wire may fall and be retained from lateral movement along the frame as it is wound many times around the frame and frame 11.

Figure 4:
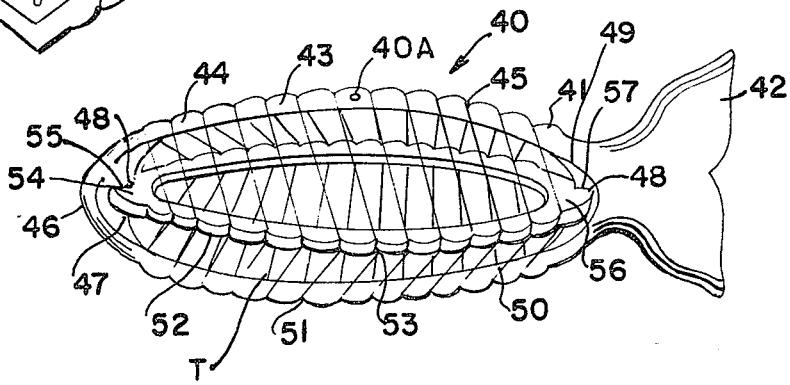
FIG. 4 shows a modified form of filament winding craft representing a mock fish with a filament completely wound thereon.

In FIG. 4 is shown a modified form of the assembly 10 of FIG. 1. The assembly 40 of FIG. 4 comprises a first molded formation 41 which is configured to represent the outline of a mock fish while a second oblong frame formation 52 is supported within the frame 41 in a manner similar to that in which frame 30 is supported within frame 11.

The formation 41 is composed of a tail portion 42 and a body defining portion 43 which is essentially an oblong and somewhat eliptically shaped frame having scallop formations 44 formed around the outer edge of the frame and defining respective indentations 45 in the outer edge for receiving and defining the locations of turns of a flexible filament or thread T wound many times therearound as illustrated.

Notation 46 refers to the front end of the frame 43 which has formed along its inside border a fillet formation 47 containing a notch-like indentation 48 therein into which notch indentation fits and is frictionally secured the inside frame 50. Notation 49 refers to a fillet formation at the opposite end of frame 43 near the tail portion 42 thereof. The frame 50 contains a notch-like indentation 52 at the forward end 54 thereof and a second notch-like indentation 57 at the rear end 56 of the frame. These indentations each frictionally assemble within notch-like indentations in the fillet formations 47 and 49 at the ends of the frame 43. Frame 43 contains scallop-like formations 44 while frame 50 contains scallop formations 52 defining indentations between each two scallop formations which are denoted 53. Alignment is effected between the indentations 45 in the frame 43 and the indentations 52 in the frame 50 when the frame 50 is predeterminately aligned within and secured to the frame 43. When the frames 43 and 50 are secured together as illustrated in FIG. 4 and a flexible wire, thread or plastic filament is wound many times around the combined frames, an art form or assembly is provided which is pleasing to look at and reflects the skill of the person assembling the frames and thread T. While two basis forms are illustrated respectively in FIGS. 1–3 and FIG. 4, it is to be noted that a variety of differently contoured forms may be provided representative of various animals, birds or other familiar shapes.

Figure 5:
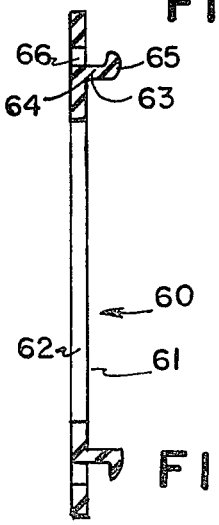
FIG. 5 shows a further embodiment.

In FIG. 5 is shown a modified form of the invention which includes an art frame 60 which may be peripherally configured similar to frames 11, 30, 43 and 50 of FIGS. 1–3 and FIG. 4 or may be utilized per se as a wire or filament wrapping craft and toy. The unit 60 is comprised of a molded plastic frame 61, the inside 62 of which is void of frame materials. Molded integral with the frame materials 61 are a plurality of retaining protrusions 63, each containing a shank 64 and head portion 65 which protrudes laterally outwardly from one side of the shank 64. An opening 66 is provided through the frame in alignment with the head 65 to permit it to be easily molded by means of a protrusion or pin extending from one wall of the mold and defining the inside surface of the shank 63, the opening 66 and the underside of the head 64. By providing a plurality of the formations 63 molded integral with the frame 61, each may be utilized to retain and define the location of a turn of the thread, wire or filament which is wrapped across the frame between molded protrusions 63.

The frame 61 may be employed per se in the contour or configuration of a fish, animal, character, vehicle, building, flower or other shape with the wire or filament wrapped back and forth between the multiple integrally molded protrusions 63 many times to define an envelope of filamentary formations extending across the frame 61 and the opening 62 therein.

In a modified form of the invention illustrated in FIG. 5, the opening 62 may be eliminated and the molding 60 may define a plate across which one or more wires, threads or plastic filaments may be wrapped back and forth between headed protrusions such as formations 63 to dispose arrays of portions thereof across selected portions or a portion of the plate. The plate may be configured to represent a character, animal or art form or may be rectangular or oval in shape to define a picture forming background on which different colored threads, filaments or wires may be retained.

Plastics of which the frames of FIGS. 1–5 may be molded include polystyrene, cellulose acetate, polyethylene, polypropylene and other self supporting plastic resins.

In further forms of the invention it is noted that the structures shown in FIGS. 4 and 5 may be modified in shape or contour to define a variety of configurations which are representative of animals and other familiar objects. The mock fish structure of FIG. 4 may be modified, for example, to provide a variety of different fish, animals, birds, insects, human and cartoon characters, boats, motor vehicles, blimps and aircraft, flowers, trees, buildings, plants and other objects by inserting one frame inside the other, as shown, and thereafter winding one or more strings, threads or wires around the assembly as shown.

The embodiment shown in FIG. 5 which employs a single injection molded plastic frame with a plurality of molded stud portions with semi-heads 65 for retaining wrapped wires, threads or filaments, may also be configured in contour or outline to represent characters, animals, fish, vehicles, flowers and plants, boats, stars, quarter moons, and other shapes which may be developed into attractive art pieces by winding such filamentary material thereacross between pairs of opposed retaining studs or stud-like formations 63.

It is also noted that filament or wire wound objects of the types shown in FIGS. 3 and 4 may contain one or more electric light bulbs or lamps supported within the windings on wires attached to holes or retainers molded onto the frames or to molded retaining portions of the frames. Such lamps may be battery powered by batteries located on or within the frames or the wires thereof may attach to the frame and then extend upwardly for holding the assembly, to an electric socket or coupling device supported by a frame or lamp base.

In addition to hanging the frames and assemblies of FIGS. 4 and 5 from flexible strings or filaments, the assemblies may be supported from below by frictional engagement of the frame with a retainer.

I claim:

1. An assembly toy and craft comprising in combination:

a first member shaped in the configuration of a closed frame and having integrally formed therein of the material thereof a plurality of irregular formations which are configured to receive and retain a filamentary material, a second member of sheet-like configuration and having the peripheral border portions thereof shaped with a plurality of irregular formations for retaining a filamentary material, respective inside edge portions of said first frame member and outside edge portions of said second frame member being configured to permit the frictional assembly and retention of said second frame member within and across the inside of said first frame member whereby most of the border portions of said second frame member extend laterally outwardly of said first frame member and wherein said irregularly shaped formations of said first and second frame members are exposed to and may serve as guides for a filamentary material such as a thread, metal wire or flexible plastic filament which is wrapped around the assembly a number of times and may be retained by the side surfaces of said irregular formations as a plurality of turns of a winding of said filamentary material around the assembly of said first and second members wherein each of said turns is substantially fixed in location on the assembly with respect to the other turns of filamentary material.

2. A toy and craft in accordance with claim 1 wherein each of said irregular formations formed in said first and second members is of substantially similar configuration as a plurality of the others permitting the filamentary material wrapped around the assembly to be formed into a plurality of turns of substantially equal spacing.

3. A toy and craft assembly in accordance with claim 1 wherein said irregular formations in said first and second members comprise irregular formations along the outer edges of said first and second members.

4. A toy and craft in accordance with claim 3 wherein said irregular formations along the outer edges of said first and second members comprise scallopping therein defined by respective narrow gullies between adjacent scallop formations with each gully adapted to receive and retain at least one turn of said filamentary material against sliding movement along the edge of the member.

5. An assembly toy and craft in accordance with claim 1 wherein said second member is also configured in the shape of a frame.

6. An assembly toy and craft in accordance with claim 1 wherein said first member contains respective slot-like indentations formed in its inside surface diametrically across the frame and said second member is configured with portions thereof adapted to frictionally assemble with and be retained by the surfaces of said slot-like indentations in said inside portions of said first member.

7. An assembly toy and craft in accordance with claim 1 wherein said first and second members are configured to represent, when assembled together, a character such as an animal, fish or other known character shape and the wrapping of a filamentary material a number of times around the assembly of said first and second members is operable to form an envelope of said filamentary material which somewhat represents the three-dimensional surface configuration of said character.

* * * * *